US005328232A

United States Patent [19]

Whitehead

[11] Patent Number: 5,328,232

[45] Date of Patent: Jul. 12, 1994

[54] FOLDABLE PLASTIC CHAIR

[75] Inventor: Steven P. Whitehead, Elgin, Ill.

[73] Assignee: Suncast Corporation, Batavia, Ill.

[21] Appl. No.: 900,157

[22] Filed: Jun. 17, 1992

[51] Int. Cl.[5] ..... A47C 4/00

[52] U.S. Cl. ..... 297/58; 297/50; 403/348

[58] Field of Search ..... 297/58, 57, 55, 50; 403/289, 348, 349, 397; 292/347, DIG. 38; 108/129, 117

[56] References Cited

U.S. PATENT DOCUMENTS

| | | | |
|---|---|---|---|
| 195,576 | 9/1977 | Cogswell . | |
| 1,562,226 | 11/1925 | Glantz . | |
| 1,633,721 | 6/1927 | Young . | |
| 1,716,526 | 6/1929 | Mason . | |
| 1,721,294 | 7/1929 | Dean . | |
| 1,724,055 | 8/1929 | Wagner . | |
| 1,948,216 | 2/1934 | Gilette | 297/58 |
| 2,005,565 | 6/1935 | Schermerhorn . | |
| 2,261,588 | 11/1941 | O'Connor . | |
| 2,381,574 | 8/1945 | Clarin . | |
| 3,857,604 | 12/1974 | Scott . | |
| 3,936,907 | 2/1976 | Jansons . | |
| 3,982,450 | 9/1976 | Marsh | 403/349 |
| 4,123,101 | 10/1978 | Minsker . | |
| 4,441,757 | 4/1984 | Gascaburges | 297/55 |
| 5,094,148 | 3/1992 | Haber et al. | 403/348 |

*Primary Examiner*—Michael Milano

*Attorney, Agent, or Firm*—Fitch, Even, Tabin & Flannery

[57] ABSTRACT

Disclosed is a foldable, injection molded plastic chair in which the seat of the chair is engageable in a generally horizontal seating position with application of little force, with the seat engagement members preventing the seat from moving out of its horizontal seating position until application of significantly greater force thereto, thereby providing a chair having improved load withstanding capability. The seat is mounted for pivotal engagement to the legs of the chair by an improved keyed post interlock arrangement which can withstand heavy loading and still retain the pivotal engagement of the seat with the chair legs.

10 Claims, 3 Drawing Sheets

10
12
14
16
18
20
22
24
26
28
30
32
34
36
40
41
42
44
46
48
50
52
53
54
55
56
64
70
72
74
80
82

22
41
80
3
42
42
90
82
44
38
3
82
20
40
22
70
74
54
56
72
76
60
66
d
4
4
66
64
65
65
53
52
53
20
38
53
55

41
46
42
22
40
20
44

20
46
48
64
60
64
53
54
53
32

FOLDABLE PLASTIC CHAIR

FIELD OF THE INVENTION

This invention relates to foldable plastic chairs, and more particularly, relates to foldable plastic chairs having means for locking the chair seat in a generally horizontal seating position.

BACKGROUND OF THE INVENTION

A wide variety of foldable plastic chairs have been designed which allow a chair to be unfolded and the seat lowered to a horizontal position for use, and allow the seat to then be raised and the chair collapsed into a folded position following usage. For safety reasons, it is important that the chair, when in its unfolded seating position, be able to withstand the substantial dynamic loads associated with persons sitting on the seat of the chair, without the seat folding or being broken.

More particularly, such chairs are often used in offices, and in this regard it is desirable that such chairs meet the American National Standard for Office Furnishings criteria as set out in ANSI/BIFMA X5.1-1985. Since these standards have been revised fairly recently, many previous chair designs do not meet these standards. It is desirable to provide a foldable plastic chair which is lightweight, comprised of a minimal number of components, easily moved between extended and folded positions without any special knowledge of the chair's operation, lends itself to low cost production and yet still meets the safety criteria set out in the aforementioned ANSI standards.

SUMMARY OF THE INVENTION

In accordance with the present invention a foldable plastic chair is provided having the capacity to withstand greater seat loading than current chairs of similar configuration. The chair comprises three main sections of molded plastic, a front leg frame, a rear leg frame and a seat, which are interconnected.

The front leg frame and rear leg frame both span the lateral sides of the seat, with both leg frames including spaced left and right legs between which the seat is mounted. The front and rear leg frames are pivotally connected to one another near their upper ends.

The seat is pivotally supported by the front leg frame at a location approximately midway between the front and rear ends of the seat, and slidably engaged by the rear leg frame at the rear of the seat.

The opposite lateral sides of the seat include apertures which receive protrusions extending inwardly from the left and right legs of the front leg frame to pivotally support the seat at its midspan in the space between the left and right legs of the front leg pair.

The seat is supported near its rear end by sliding engagement of pins, extending from the opposite lateral sides of the seat near its rear, within guide channels provided on the inner legs of the rear leg frame. Upon reaching the horizontal seating position, the pins bear against the upper end of the guide channel to provide support to prevent further rotation of the seat.

In accordance with the present invention, the upper ends of the guide channels include reinforcing ribs, at least one of which is vertically oriented, to provide additional structural support sufficient to enable the chair to withstand greater front end seat loading without the chair collapsing than with currently manufactured chairs. The reinforcing at the upper end of the guide channel has been found to provide the chair with the requisite capacity to withstand the drop test of Section 9 of the ANSI standards.

Also, the upper ends of the guide channels include ramps or cams on opposite interior sides which narrow the guide channels at their upper ends. The pins integral with the seat are forced upward between the channel-narrowing ramps upon lowering of the seat to its fully seated position, whereby the pins are locked by a snap-fit engagement at the upper end of the guide channel. The snap-fit engagement of the pins at the upper end of the guide channel allows for greater rear end loading of the seat without the seat moving to its raised, folded position.

A particular feature of the present invention is that the ramps extending into the channel extend perpendicularly from the channel walls at the upper end of the ramps and taper into the channel walls at the lower end of the ramps. This allows the pins to be moved past the ramps in the upward direction significantly easier that the pins can be moved past the ramps in the downward direction. Hence, the seat can be pivoted and locked in its horizontal seating position with minimal force, with it requiring substantially greater force to thereafter move the seat out of its horizontal seating position.

Additionally, in accordance with the present invention, the aforementioned pivotal engagement of the seat with the front leg frame is by an improved dual keyed post interlock which provides improved structural support to maintain the inwardly extending leg frame protrusions within the seat apertures. The hollow, inwardly extending leg frame protrusions also include a vertical support rib therein to provide increased loading capacity to allow the seat to withstand greater loads than current designs.

The chair of the present invention is comprised of a minimal number of components, lends itself to simple construction, is lightweight, inexpensive to produce, and yet still provides significantly improved structural soundness and other safety characteristics as compared with currently manufactured plastic foldable chairs.

BRIEF DESCRIPTION OF THE DRAWINGS

In the drawings, wherein like elements are referenced alike.

DETAILED DEESCRIPTION OF THE PREFERRED EMBODIMENT

Figure 1:
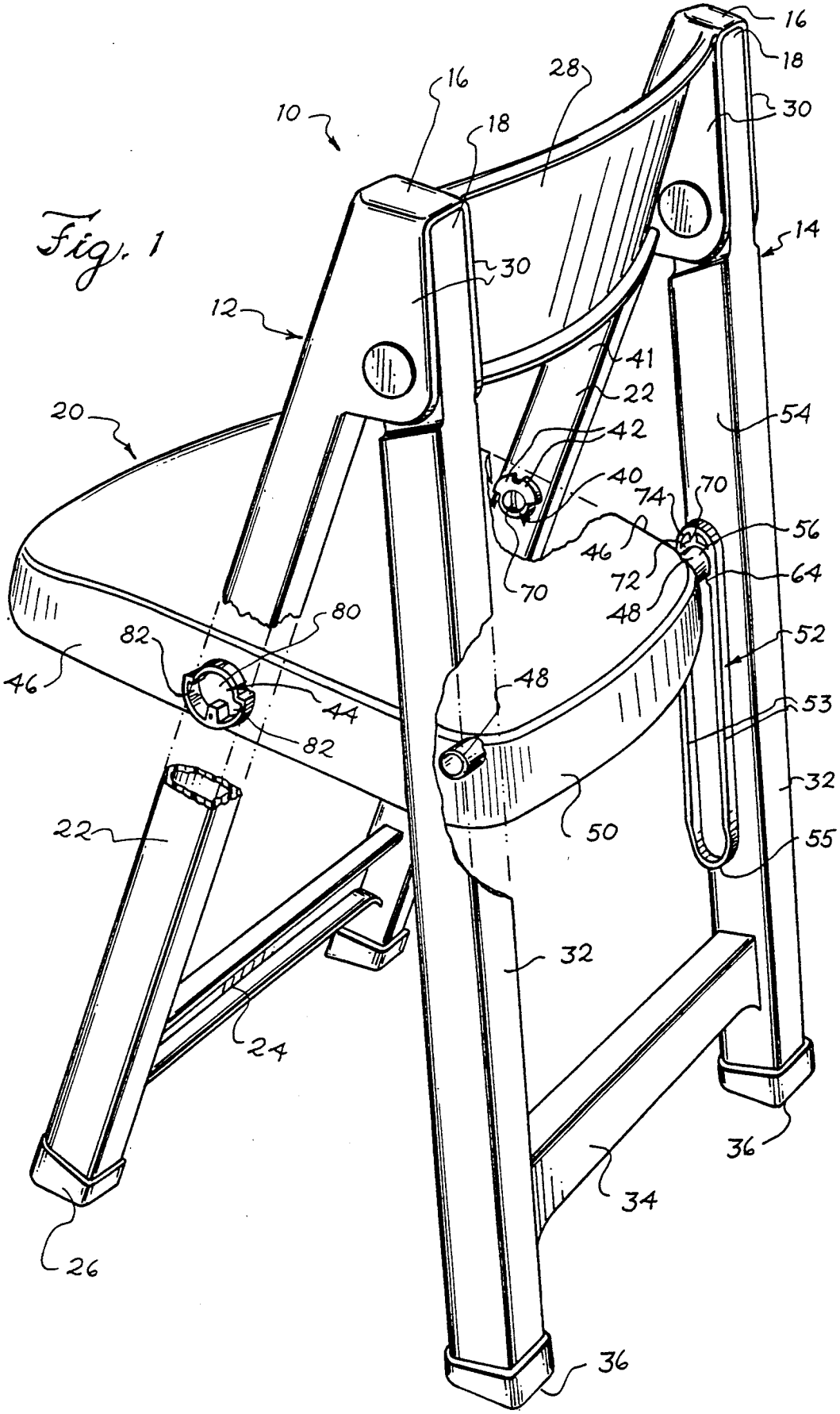
FIG. 1 is a perspective view of a chair embodying various features of the present invention.

A chair embodying various features of the present invention is illustrated in FIGS. 1-4 and referred to generally at 10. With initial reference to FIG. 1, the chair 10 is comprised of three principal parts, each integrally molded, which, when assembled and viewed from the side, form a folding A-frame. A front leg frame 12 and a rear leg frame 14 are pivotally connected together near their upper ends 16 and 18, respectively, with a seat 20 spanning the front leg frame 12 and rear leg frame 14.

The front leg frame 12 is an integrally molded component having two front legs 22 which are maintained in a spaced relation by a channel-shaped cross brace 24 spanning the front legs 22 near their lower ends 26, and a curved backrest 28 spanning the front legs 22 near their upper ends 16. At the upper end 16 of the front legs 12 is a rearwardly-open pocket extended rearwardly by side flanges 30 to accept the upper ends 18 of the rear leg frame 14 when the chair is opened.

With continued reference to FIG. 1, the rear leg frame 14 is an integrally molded component having two rear legs 32 which are maintained in a spaced relation by a lower channel-shaped cross brace 34 spanning the rear legs 32 near their lower ends 36. The seat 20 is an integrally molded component which is pivotally connected to the front leg frame 12 by keyed post interlocks 38.

Each of the front legs 22 has molded integral therewith a tubular trunnion or post 40 extending from its inside surface 41 having two keys 42. Keyhole sockets 44 molded on opposite lateral sides 46 of the seat 20 accept the keyed trunnions or posts 40 for pivotal movement therein. The keyhole socket 44 has a configuration complementary to the shape of the keyed trunnion 40 so that the keys 42 only pass through the sockets 44 when the keys and sockets are in registration. In the preferred embodiment of the invention, the keyed trunnion 40 and the keyhole socket 44 are in registration with one another when the seat 20 is upside-down with respect to an upright trunnion 40. Hence, in assembling the chair 10, the seat 20 is turned upside-down, the keys 42 inserted through the keyhole sockets 44, and the seat 20 then turned upright by pivoting about the trunnion 40 to move the keys 42 out of registration with the keyhole sockets 44. As best seen in FIG. 1, the lateral sides 46 of the seat 20 preferably extend outward a small amount about the periphery of the keyhole socket 44 to provide greater surface area contact between the trunnion 40 and the seat 20.

During the pivotal movement of the seat 20 between its raised, folded position and its lowered, seating position, the seat does not move to the upside down position. Hence, in operation, the keys 42 do not move into registration with the keyhole sockets 44 and therefore engagement of the keyed trunnion 40 within the keyhole socket 44 is maintained upon seat pivoting. Accordingly, the seat is supported on, and pivots about, the trunnion or post 40. This keyed post interlock 38 provides significant improvements over keyed post interlocks of the prior art, as will be explained in detail further below.

The seat is slidably and pivotally connected to the rear leg frame 14 by a pair of engaging pins 48 molded integral with the seat 20 which extend laterally outward near the rear end 50 of the seat 20. The pins 48 are received within guide channels 52 integrally molded on the inside surfaces 54 of the rear legs 32. As best seen in FIG. 1, the channels 52 are defined laterally by elongated sidewalls 53 which extend from the inner side 54 of the rear legs 32. In assembling the chair 10, the rear legs 32 are forced apart or bowed outwardly to accept the pins 48 of the seat 20. The legs are thereafter allowed to return to their natural, straight position with the pins 48 confined within the channel 52.

When the seat 20 is in its folded, raised position, the front leg frame 12 is folded adjacent the rear leg frame 14 and the pins 48 reside at the lower end 55 of the channel 52. When the seat 20 is moved to its lowered, seating position, the front leg frame 12 is moved away from the rear leg frame 14 and the pins 48 are slid to the upper end 56 of the channel 52.

Seat locking means 60 are provided near the upper ends 56 of the channels 52 for engaging the pins 48 of the seat 20 to secure the pins 48 at the upper ends of the channels 52 when the seat 20 is moved to its lowered, seating position, as shown in FIG. 1. In accordance with the present invention, the seat locking means 60 is constructed such that it allows the pins 48 to easily slide past the seat locking means 60 in the upward direction, but provides significant resistance to passage of the pins 48 past the seat locking means in the downward direction.

Hence, once the seat 20 has been lowered to its seating position and the pins 48 engaged by the seat locking means 60, the engagement of the pins with the seat locking means 60 prevents the seat 20 from inadvertently moving toward the raised, folded position. Thus, even upon imposition of substantial loading near the rear end 50 of the seat 20, the seat locking means 60 engages the pins 48 to prevent them from moving downward, and thereby preventing the seat 20 from pivoting upward under the applied load.

Figures 5, 6, 7:
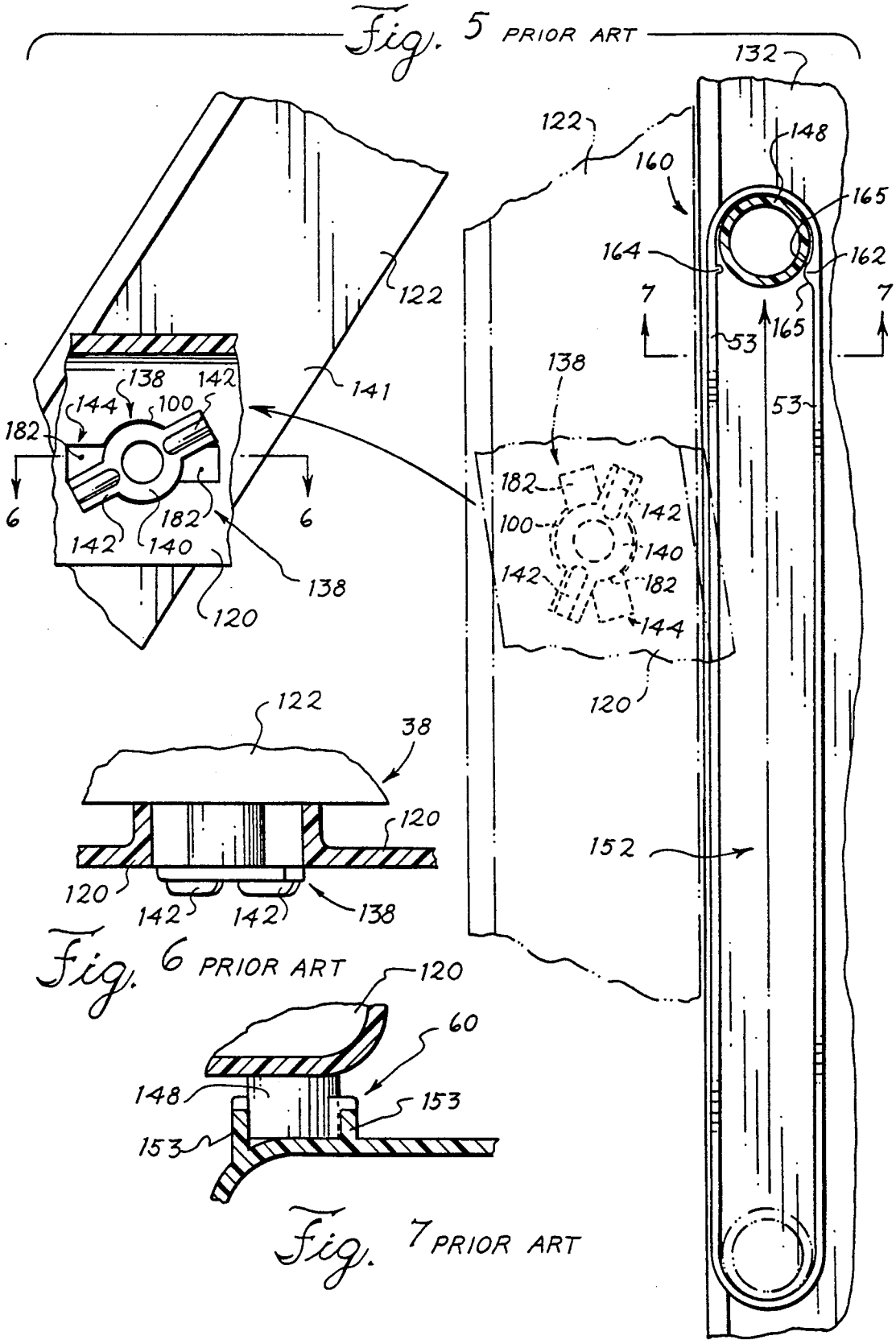
Fig. 5 PRIOR ART
Fig. 6 PRIOR ART
Fig. 7 PRIOR ART
FIG. 5 is a side elevational view of the channel and keyed post interlock of a prior art chair.
FIG. 6 is a cross-sectional view of the prior art keyed post interlock taken along line 6—6 of FIG. 5.
FIG. 7 is a cross-sectional view of the upper end of the prior art channel taken along line 7—7 of FIG. 5.

The seat locking means 160 of a previously manufactured chair is illustrated in FIGS. 5 and 7. As seen in FIG. 5, the seat locking means 160 of this prior art chair comprises a large bump 162 and a small bump 164 extending into the channel 152 from opposite sides near the upper end 156 of the channel 156. The large bump 162 of the prior art chair has tapered sections 165 which are tapered generally identically at both the upper end of the bump 162 as well as the lower end of the bump. The small bump 164 is essentially a raised line extending generally horizontally within the channel 152 from the inside of the channel, on the side opposite the large bump 162. The small bump 164 is also symmetrical between its upper end and its lower end. Hence, the resistance to passage of the pins 148 past the bumps 162 and 164 in this chair is the same both upward and downward.

Figures 2, 3, 4:
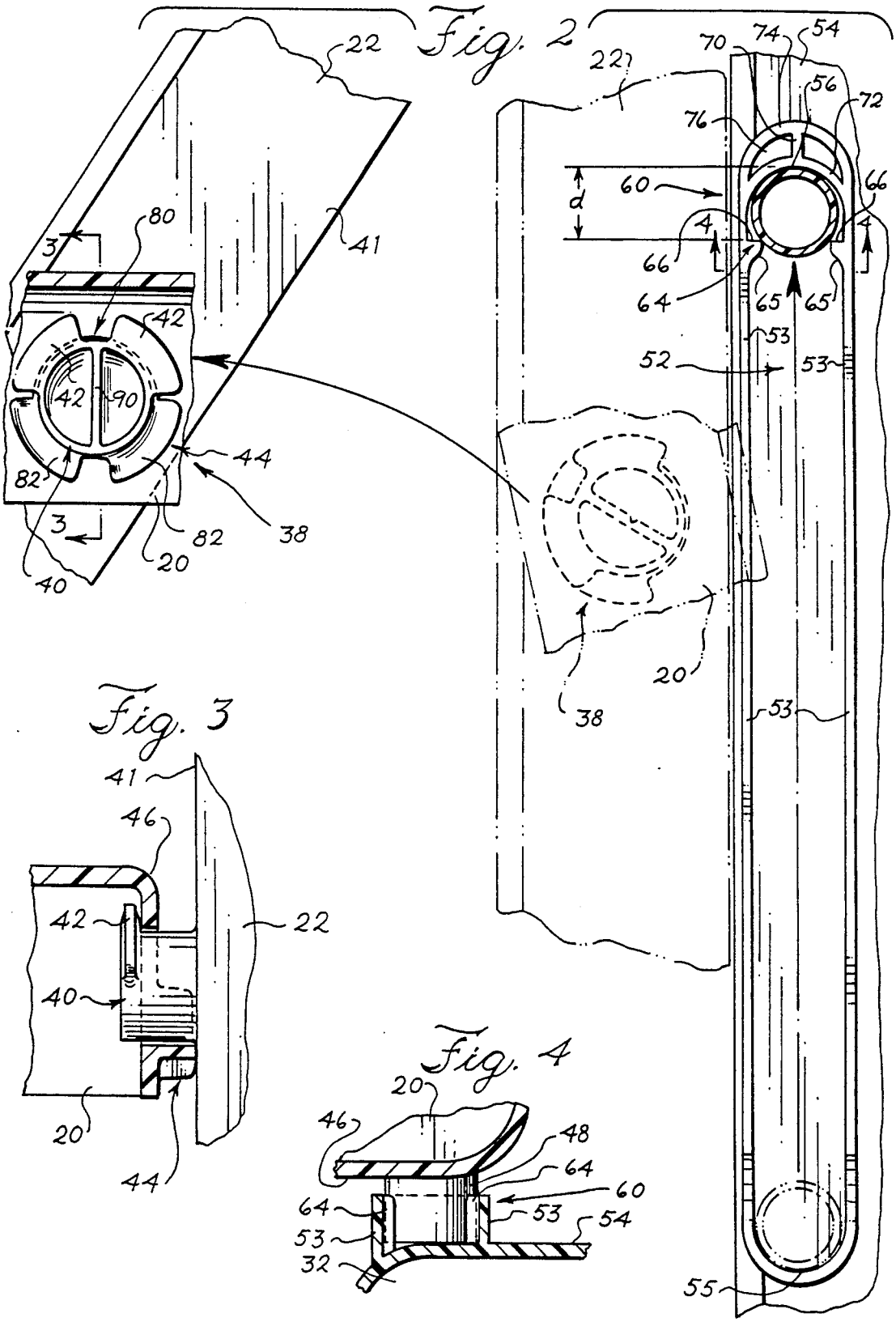
FIG. 2 is an enlarged, side elevational view of the channel and keyed post interlock of the seat of FIG. 1.
FIG. 3 is a cross-sectional view of the keyed post interlock taken along line 3—3 of FIG. 2.
FIG. 4 is a cross-sectional view of the upper end of the channel taken along line 4—4 of FIG. 2.

By contrast, as best seen in FIG. 2, the chair 10 of the present invention is designed to allow easy locking of the pins 48 at the upper end 56 of the channels 52 by allowing easy passage of the pins 48 past the protuberances 64 in the upward direction, while preventing the pins 48 from passing past the protuberances 64 in the downward direction without the application of significantly greater force. Hence, the chair of the present invention has the improved safety feature of withstanding significantly greater loads than prior art chairs without the chair seat collapsing to its folded position, and yet allowing the seat to be easily locked in its horizontal seating position.

In the preferred embodiment of the invention, this contrast between the force required to lock the seat and the force required to unlock the seat is attained by providing generally similar protuberances 64 on either side of the channel 52 which protuberances include ramps 65 tapering inward into the channel 52 from the lower end of the protuberances 64, with the protuberances 64 terminating at a flat, horizontal upper surface 66, as illustrated in FIG. 2.

The force of the pins 48 against the protuberances 64 resiliently deflects the protuberances 64 outwardly to allow the pins 48 to pass therebetween. When the pins 48 bear against the ramps 65 of the protuberances 64, which ramps are only slightly off of vertical, the pins 48 exert a significantly greater horizontal vectoral force than vertical vectoral force. Since it is the horizontal vectoral force which deflects the protuberances outward, and a substantial amount of the force applied to urge the pins 48 past the protuberances is translated to a horizontal force acting on the protuberances due to the ramped incline, the pins 48 deflect the protuberances 64 outward and pass therebetween in the upward direction with relatively minimal force.

However, in attempting to raise the seat 20 to its folded position, and hence, move the pins 48 back downward past the protuberances 64, the pins 48 bear against the generally flat, horizontal upper surfaces 66 of the protuberances 64. Since this portion of the protuberances 64 are generally horizontal, the pins 48 exert a significantly greater vertical vectoral force than horizontal vectoral force on the protuberances 64. That is, a significantly greater portion of the downward force applied to the rear end 50 of the seat 20, and hence to the pins 48, is exerted by the pins 48 on the protuberances 64 in a downward vertical direction, rather than horizontally. Since, as stated above, it is only the horizontal forces of the pins 48 acting on the protuberances 64 which effect deflection of the protuberances 64 outward to allow the pins 48 to pass between the protuberances 64, significantly greater force is necessary to move the seat 20 out of its locked seating position than is necessary to move the seat into its locked seating position. Application of the same force employed to move the pins upward past the protuberances 64 is not sufficient to move the pins downward past the protuberances 64.

This additional resistance to raising of the seat 20, and hence to folding of the chair 10, is of sufficient magnitude that the chair 10 of the present invention can withstand significantly greater loads than currently manufactured chairs, without a corresponding increase in the difficulty of locking the seat of the chair in its lowered seating position.

To further allow the chair 10 of the present invention to withstand greater loads than currently manufactured chairs, the upper end 56 of the channel 52 is reinforced by a vertically extending reinforcing rib 70 (see FIG. 2). With reference to FIG. 2, the upper end 56 of the channel 52 is defined by a lower arcuate section 72. An additional, upper arcuate section 74 is formed integral with the lower arcuate section 72 and extends above the lower arcuate section 72. Reinforcing rib 70 extends vertically in the gap 76 between the upper and lower arcuate sections 74 and 72, spanning the upper and lower arcuate sections.

While the lower arcuate section 72 could be made thicker to provide the desired additional structural strength, such as by filling in the entire gap 76, the vertical reinforcing rib 70 arrangement of FIG. 2 provides significant advantages over such an arrangement. A particular advantage of the provision of the vertical reinforcing rib 70 is in the resiliency which it affords upon dynamic loading. Upon heavy dynamic loading, there may be a small amount of resilient flexion of the lower arcuate section 72 upward into the gap 76 between the lower and upper arcuate sections 72 and 74, with the reinforcing rib 70 flexing to allow this. However, if the upper end 56 of the channel 52 were simply made thicker, there would be little or no resiliency of the lower arcuate section 72 and, hence, there would be a tendency for stress fractures to occur with significantly lower loads than with the chair 10 of the present invention.

Also, the pins 48 extending from the sides of the seat extend as far into the channel 52 as possible so as to provide a larger area of contact with the ramped or cammed protuberances 64 to maximize the resistance to seat movement from the locked, horizontal seating position.

As shown in FIG. 2, the distance d between the upper end 56 of channel 52 and the horizontal upper surfaces 66 is preferably slightly less than the outer diameter of pin 48. According to the present invention, the distance d is dimensioned so as to lie within a range between 0.5 to 1.0 times the outer diameter of pin 48.

In laboratory testing, the chair 10 of the present invention was able to withstand a load of 260 lbs. dropped onto the seat from 6 inches without failing, whereas the prior art chair failed in similar testing with a load of only 175 lbs.

In addition to the improved channel 52, another improvement of the chair 10 of the present invention over the aforementioned currently manufactured chair is in the keyed post interlocks 38 by which the seat 20 is pivotally connected to the front leg frame 12.

The keyed post interlock 138 of the currently manufactured chair is illustrated in FIGS. 5-7. As with the chair 10 of the present invention, both of the front legs 122 of the currently manufactured chair have molded integral with the front legs 122 an inwardly extending tubular trunnion 140 on the inside surface of the legs having two keys 142. Keyhole sockets 144 molded in opposite lateral sides of the seat 120 accept the keyed trunnions 140 for pivotal movement therein, with the keyhole socket 144 having a configuration complementary to the shape of the keyed trunnion 140. During the pivotal movement of the seat 120 between its raised, folded position and its lowered, seating position, the keys 142 maintain engagement of the keyed trunnion 140 within the keyhole socket 144.

In the currently manufactured chair of the prior art, the pair of keys 142 are narrow and extend radially outward from opposite sides of the trunnion 140. The keyhole socket 144 has a generally circular aperture 100 with narrow cutouts 182 extending radially outwardly from opposite sides of the circular aperture 100. The cutouts 182 are made complementary to the keys 142 so that during assembly, the keys 142 pass through the cutouts 182 with minimal clearance. During usage of the chair, the narrow keys 142 do not align with the narrow cutouts 182, so that the seat does not become disengaged from the front legs 122.

The circular apertures 100 are made larger than the trunnions 140 so that there is clearance about the periphery of the trunnions 140 which allows free pivotal movement of the seat 120 about the trunnions 140. When a load is applied to the seat 120 of the currently manufactured prior art chair, the upper ends of the circular apertures 100 bear downward against the upper ends of the trunnion 140. Hence, when a load is applied to the seat 120, this eliminates the gap above the trunnion 140 and creates a wider clearance below the trunnion 140. As best seen in FIG. 5, with the currently manufactured prior art chairs, this downward shifting results in an increase in the portion of the cutouts 182 overlapping the lower key 142. This results in increased stress to the keys 142 since the lateral seat load is required to be taken up by a smaller key area.

To minimize the stress to the keys 42 in the chair 10 of the present invention, two keys 42 are provided on the same, upper side of the trunnion 40, rather than extending from opposite sides of the trunnion 40 as practiced in the currently manufactured prior art chairs. With reference to FIG. 2, when the seat 20 of the present invention is in its horizontal seating position, the keys 42 do not overlap the cutouts 82 of the keyhole socket 44. Hence, the entire surfaces of the keys 42 take up the lateral seat load, rather than just a portion of the keys taking up the lateral seat load, as is the case with the currently manufactured prior art chairs.

Also, the downward seat loading results in the gap between the trunnion 40 and the circumference of the aperture 80 being completely taken up above the trunnions 40, and being enlarged below the trunnion 40, which further assures that the seat 20 bears against the entire surface of the keys 42. The increased gap below the trunnions 40 does not affect the stress on the keys 42. As seen in FIG. 5, this is in contrast with the currently manufactured chair of the prior art in which the increase in the gap on the lower side of the trunnion 140 results in a corresponding increase in the overlap of the cutouts 182 with the lower key 142, and hence a reduction in the surface area of the lateral side of the seat 120 bearing against the keys 142.

Also, the keys 42 are made wide in the chair 10 of the present invention to further minimize stress, in contrast with the narrow keys 142 of the currently manufactured chairs. More particularly, with the present chair 10, the keys 42 preferably each extend over approximately 1/5 of the circumference of the trunnion 40; whereas in the currently manufactured chairs, each of the keys 142 extends over only approximately ⅛ of the trunnion circumference.

Another improvement in the keyed post interlocks 38 of the chair 10 of the present invention over the keyed post interlocks 138 of currently manufactured prior art chairs is in the ability of the trunnions 40 of the present invention to withstand greater vertical loading. The trunnion 40 is preferably made hollow to minimize material costs and a rib 90 is provided which extends diametrically across the interior of the trunnion 40. With reference to FIG. 2, it is seen that the rib 90 is oriented such that it extends substantially vertically when the seat 20 is moved to its horizontal seating position. This provides additional structural support to the trunnion 40 which prevents the trunnion 40 from bending downward under an applied vertical load.

From the above discussion, it will be appreciated that the chair of the present invention lends itself to manufacture by injection molding, thereby allowing the chair to be produced at a low cost while still meeting current safety criteria.

While only specific embodiments of the invention have been described and shown, it is apparent that various alterations and modifications can be made therein. It is, therefore, the intention in the appended claims to cover all such modifications and alterations as may fall within the scope and spirit of the invention.

What is claimed is:

1. A foldable chair, comprising:

a seat having a front end, a rear end and opposite lateral sides, with apertures provided in the lateral sides approximately midway between the front end and rear end, and pivot pins extending outward from the lateral sides at the rear end of the seat;

a front leg pair having spaced integral left and right legs both having inwardly extending projections pivotably received within the apertures in the lateral sides of the seat to support the seat for pivotal movement between the left and right legs of the front leg pair;

a rear leg pair having spaced integral left and right legs both having inwardly extending channels with upper and lower ends which receive therein the pivot pins extending from opposite lateral sides of the seat for pivotally and slidably supporting rear of the seat between the left and right legs of the rear leg pair;

the rear leg pair and front leg pair being pivotally interconnected with one another above the seat with the pivot pins sliding to the upper end of the channel upon pivoting apart of the front and rear leg pairs as the seat approaches its generally horizontal seating position; and the channel being of generally uniform width comprising front and rear channel sidewalls between which the pivot pin slides from the lower end of the channel when the seat is raised, to the upper end of the channel when the seat is lowered, the channel further comprising ramps extending inwardly from the opposite front channel sidewalls and rear channel sidewalls at the upper end of the channel for camming engagement of the pivot pins thereat to secure the pivot pins at the upper end of the respective channels to secure the seat in its generally horizontal seating position; and the upper end of the channel reinforced with at least one vertically extending reinforcing member thereat to provide additional structure support to the upper end of the channel to allow the chair to withstand increased seat loading without structural failure.

2. A chair in accordance with claim 1 wherein the ramps extending inwardly from the opposite channel sidewalls terminate at flat upper ends, the pivot pins bearing against the flat upper ends to substantially inhibit downward movement of the rear of the seat within the channel.

3. A chair in accordance with claim 1 wherein the flat upper ends of the ramps are spaced from the upper end of the channel a distance between 0.5 and 1.0 times the diameter of the pivot pins.

4. A foldable plastic chair of the type having a front leg frame pivotally connected to a rear leg frame, with a seat spanning the leg frames which is connected at its rearward sides by slidable engagement of pins protruding from the sides of the seat near its rear end within channel means provided on the rear leg frame, with the seat pivotally connected to the front leg frame by posts extending inward from the rear leg frame into sockets formed in the seat approximately midway between the front and rear ends of the seat, the improvement comprising:

said posts each comprising an integral, generally cylindrical portion having a terminal end with two keys extending radially outward from the cylindrical portion at said terminal end, with both of said keys being situated within less than 180 radial degrees of one another;

said sockets each comprising a generally circular cutout in a lateral side of said seat proportioned to receive said cylindrical post portions, and further comprising two keyway cutouts, in communication with the circular cutouts, which keyway cutouts are situated within 180 radial degrees of one another and proportioned to receive said keys of said posts when in registration therewith; and said keys retaining said posts within said sockets following insertion of said posts through said sockets and rotation of said post relative to said socket to move the keys out of registration with said keyway cutouts.

5. A chair in accordance with claim 4 wherein both of said keys are positioned at the upper half of the cylindrical portion of the post when the seat is in a horizontal seating position.

6. A chair in accordance with claim 4 wherein said cylindrical post portion has a hollow interior with a supporting rib spanning the hollow interior to provide increased structural support.

7. In a foldable plastic chair having a front leg frame pivotally connected to a rear leg frame, a pair of spaced apart, generally parallel channel walls extending from the rear leg frames so as to cooperate therewith to form an elongated pin-receiving channel having an upper end with a seat pivotally connected at its forward lateral sides to the front leg frame and the seat connected at its rearward lateral sides by slidable engagement of pins extending from the rearward lateral sides of the seat within the channel, the improvement comprising:

a pair of generally opposed protuberances extending from the upper end of the channel walls toward each other to form a channel portion of reduced width, the protuberances including generally horizontal upper surfaces extending toward one another from the channel walls, intermediate wall portions extending from the upper surfaces so as to be generally parallel to the channel walls and spaced apart with a lesser spacing than the channel walls and ramped camming walls having upper converging ends extending to the intermediate wall portions and lower end extending to the channel walls; and the intermediate wall portions being spaced apart to allow passage of the pins in the upward direction under a given applied force to the pins sufficient to spread the intermediate walls apart to thereby seat the pins at the upper end of the channel and lock the seat in a seating position, with a greater applied force to the pins required to move the pins past the protuberances in the downward direction to unlock the seat from its seating position.

8. A chair in accordance with claim 7 wherein said ramped camming walls are generally planar.

9. A chair in accordance with claim 7 wherein said ramped camming walls comprise substantially identical ramps extending into opposite sides of said channel.

10. A chair in accordance with claim 9 wherein said horizontal upper surfaces are spaced downward from the upper end of the channel a distance between 0.5 and 1.0 times the diameter of said pins.

* * * * *

UNITED STATES PATENT AND TRADEMARK OFFICE

CERTIFICATE OF CORRECTION

PATENT NO. : 5,328,232

DATED : July 12, 1994

INVENTOR(S) : Steven P. WHITEHEAD

It is certified that error appears in the above-indentified patent and that said Letters Patent is hereby corrected as shown below:

Claim 1, column 8, line 40, change "structure" to --structural--.

Claim 7, column 10, line 14, change "end" to --end--.

Signed and Sealed this

Twenty-fifth Day of October, 1994

*Attest:*

*Attesting Officer*

Bruce Lehman

BRUCE LEHMAN

*Commissioner of Patents and Trademarks*